US006260547B1

(12) United States Patent
Spencer-Smith

(10) Patent No.: US 6,260,547 B1
(45) Date of Patent: Jul. 17, 2001

(54) APPARATUS AND METHOD FOR IMPROVING THE PERFORMANCE OF A MOTOR VEHICLE INTERNAL COMBUSTION ENGINE

(76) Inventor: Michael Spencer-Smith, 1265 Olive Hill La., Napa, CA (US) 94558

( * ) Notice: Subject to any disclaimer, the term of this patent is extended or adjusted under 35 U.S.C. 154(b) by 0 days.

(21) Appl. No.: 09/495,543

(22) Filed: Feb. 1, 2000

(51) Int. Cl.[7] ..... F02D 41/14
(52) U.S. Cl. ..... 123/687; 123/694
(58) Field of Search ..... 123/687, 694, 123/695, 696

(56) References Cited

U.S. PATENT DOCUMENTS

| | | | |
|---|---|---|---|
| 4,202,301 | 5/1980 | Farly et al. | 123/688 |
| 4,479,464 | 10/1984 | Kondo et al. | 123/682 |
| 5,033,438 | 7/1991 | Feldinger et al. | 123/694 |
| 5,251,604 | 10/1993 | Kaneko et al. | 123/688 |
| 5,777,204 | 7/1998 | Abe | 73/23.32 |
| 5,836,153 | 11/1998 | Staufenberg et al. | 60/274 |

FOREIGN PATENT DOCUMENTS

| | | | |
|---|---|---|---|
| 2077962 * | 12/1981 | (GB) | 123/694 |
| 2093228 * | 8/1982 | (GB) | 123/694 |

* cited by examiner

*Primary Examiner*—Tony M. Argenbright
(74) *Attorney, Agent, or Firm*—Thomas R. Lampe

(57) ABSTRACT

A controller is interposed between the $O_2$ sensor and electronic control unit of a motor vehicle to modify the $O_2$ sensor signals before they are received by the electronic control unit so that a richer fuel mixture is introduced into the internal combustion engine of the motor vehicle than would otherwise be the case.

15 Claims, 5 Drawing Sheets

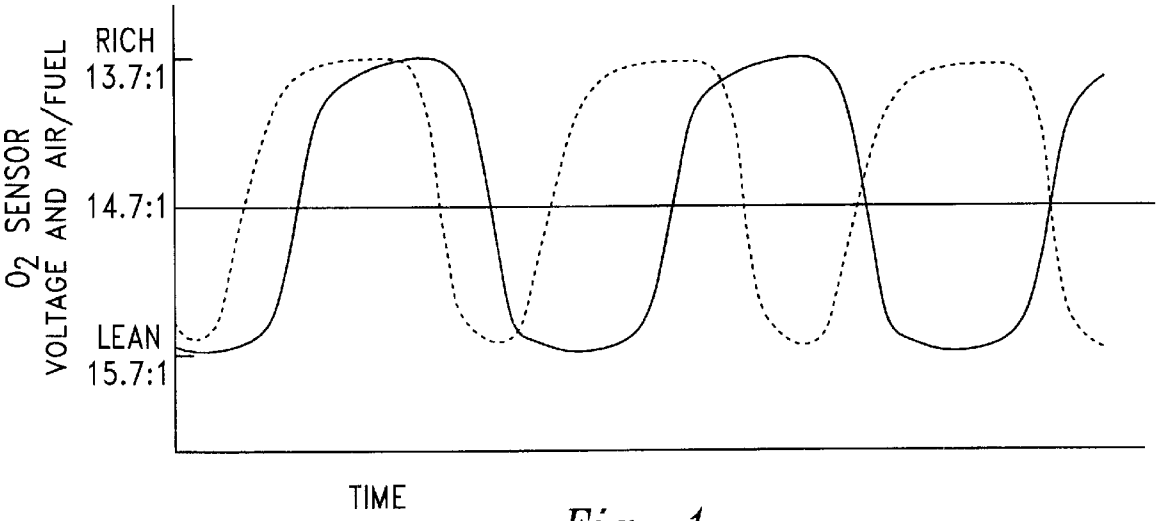
Fig. 1
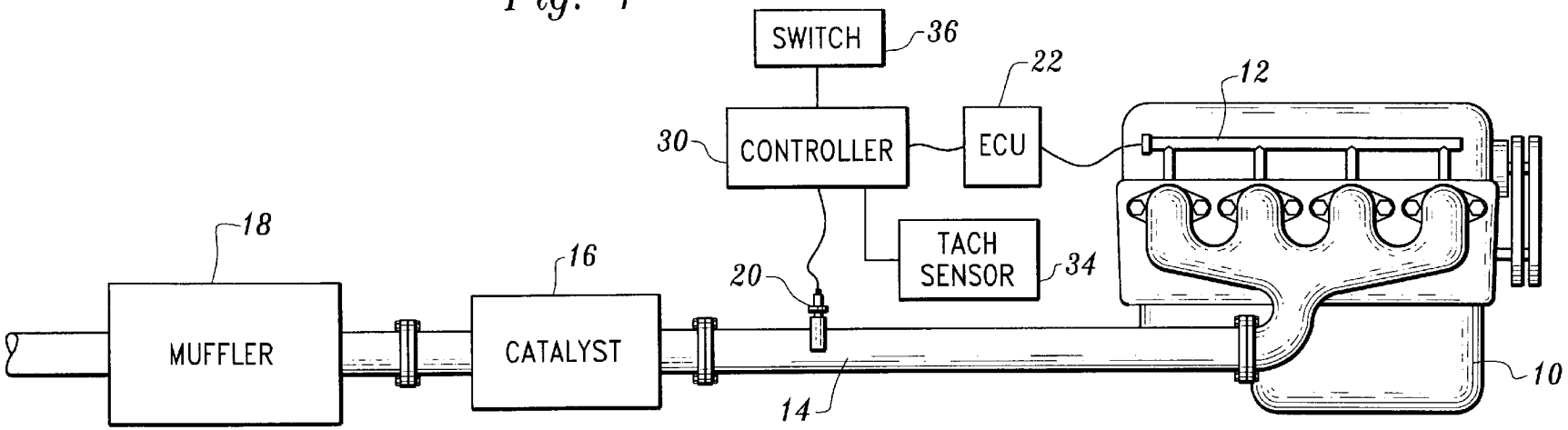
Fig. 2
Fig. 3
| | |
|---|---|
| Fig. 3A | Fig. 3C |
| Fig. 3B | Fig. 3D |

APPARATUS AND METHOD FOR IMPROVING THE PERFORMANCE OF A MOTOR VEHICLE INTERNAL COMBUSTION ENGINE

TECHNICAL FIELD

This invention relates to a system for improving the performance of the internal combustion engine of a motor vehicle. More particularly, the invention incorporates use of a controller interposed between an $O_2$ sensor and a preprogrammed electronic control unit employed in the motor vehicle to provide a richer fuel mixture than would normally be the case and thus boost the performance of the engine. The invention encompasses both apparatus and a method.

BACKGROUND OF THE INVENTION

The use of an $O_2$ sensor to sense the amount of $O_2$ in the exhaust of an automobile or other motor vehicle and to send sensor signals to an electronic control unit or module (ECU) also incorporated in the motor vehicle is well known. The terms "electronic control unit", "module", "electronic control module" and "ECU" are used interchangeably herein. The ECU is associated with the fuel injector system of the engine to control the air/fuel mixture introduced into the engine cylinders. With the fuel system in closed loop operation after the $O_2$ sensor warms up, the voltage of the $O_2$ sensor voltage cycles up and down. This cycling (which varies in speed between idling and cruising) occurs because the ECU senses the $O_2$ voltage and then changes the pulse width of the signal driving the fuel injector on and off. This switching action allows the ECU to perform minor adjustments to the air/fuel ratio to allow the catalytic converter to perform its job to optimize the "oxidation" of carbon monoxide and hydrocarbons as well as the reduction of nitrogen oxides. The oxidation occurs when the mixture is slightly lean and more oxygen is available, and the reduction occurs when the mixture is slightly rich and less oxygen is available.

It is known to modify the function of an existing electronic control unit or module (ECU) by physically changing the functional parameters of the programmable eprom or computer chip, or changing the existing eprom itself inside the ECU, in an effort to improve engine performance.

Various problems can arise when an existing ECU is modified as indicated above. The physically changed or new eprom must be specific to a manufacturer's application, and during use it may cause knocking, lean misfires, uncontrolled parameters during timed sequences and the signalling of alarming trouble codes in vehicles with on-board diagnostic (OBD) systems.

The following United States patents are known: U.S. Pat. No. 5,836,153, issued Nov. 17, 1998, U.S. Pat. No. 5,777,204, issued Jul. 7, 1998, U.S. Pat. No. 4,479,464, issued Oct. 30, 1984, U.S. Pat. No. 4,202,301, issued May 13, 1980, U.S. Pat. No. 5,033,438, issued Jul. 23, 1991, and U.S. Pat. No. 5,251,604, issued Oct. 12, 1993. As indicated above, the present invention utilizes a controller which is a separate component which is utilized with existing $O_2$ sensors and ECUs. The controller does not physically modify, change or replace the functional parameters of the existing eprom or computer chip inside the ECU in any way and it has a universal "closed loop" application. The above-identified patents do not disclose or suggest such an arrangement.

DISCLOSURE OF INVENTION

The controller of the present invention receives and interrupts the signal from the $O_2$ sensor and alters the $O_2$ sensor signal before it is received by the ECU. The controller calculates how long the $O_2$ input signal was lean, increases the last input lean period by a multiplication factor, and then adds to that last lean period. The ECU receives this modified signal from the controller and according to the ECU's original equipment manufacturer's (OEM's) pre-programmed response values, the ECU cycles richer by limiting future low end (lean period) timing signals to the fuel injectors. The effect is an ECU closed loop cycle which is richer more often than leaner during a pre-set timed sequence, without the above-stated potential problems of existing prior art arrangements and without triggering alarms in vehicles with on-board diagnostic (OBD) systems. This results in increased efficiency and performance of the engine in a range still effectively controlled by the vehicle's catalyst and emission system. In addition, the engine's Nox sensor perceives the produced richer mixture and allows the ECU to advance the engine's acceleration timing (again according to ECU pre-programmed response values) for better throttle acceleration response.

The apparatus of the present invention is for improving the performance of the internal combustion engine of a motor vehicle having fuel injectors, an $O_2$ sensor for sensing the amount of $O_2$ in exhaust produced by the internal combustion engine and a pre-programmed electronic control unit for receiving sensor signals from the $O_2$ sensor and in response thereto producing fuel injector control signals controlling operation of the fuel injectors.

The apparatus comprises a controller interposed between the $O_2$ sensor and the pre-programmed electronic control unit. The controller includes signal receiving means for receiving sensor signals from the $O_2$ sensor and sensor signal altering means for altering the sensor signals from the $O_2$ sensor prior to the sensor signals being received by the pre-programmed electronic control unit to modify the fuel injector control signals produced by the pre-programmed electronic control unit without modifying the programming thereof.

According to the method of the present invention, a controller is interposed between an $O_2$ sensor and a preprogrammed electronic control unit.

Sensor signals are directed from the $O_2$ sensor to the controller and not directly to the pre-programmed electronic control unit.

At the controller, the sensor signals from the $O_2$ sensor are modified to produce modified sensor signals.

The modified sensor signals are transmitted from the controller to the pre-programmed electronic control unit.

Without changing the programming of the pre-programmed electronic control unit, and solely as a function of the modified sensor signals being transmitted from the controller to the pre-programmed electronic control unit, modified fuel injector control signals are generated.

The modified fuel injector control signals are employed to cause the fuel injectors of the engine to provide a richer fuel mixture to the internal combustion engine over a period of time than would be provided in the absence of the step of modifying the sensor signals from the $O_2$ sensor.

Other features, advantages, and objects of the present invention will become apparent with reference to the following description and accompanying drawings.

BRIEF DESCRIPTION OF DRAWINGS

FIG. 1 is a representative oscilloscope display illustrating both a typical normal pulse wave form (shown in solid line)

Figure 3A:
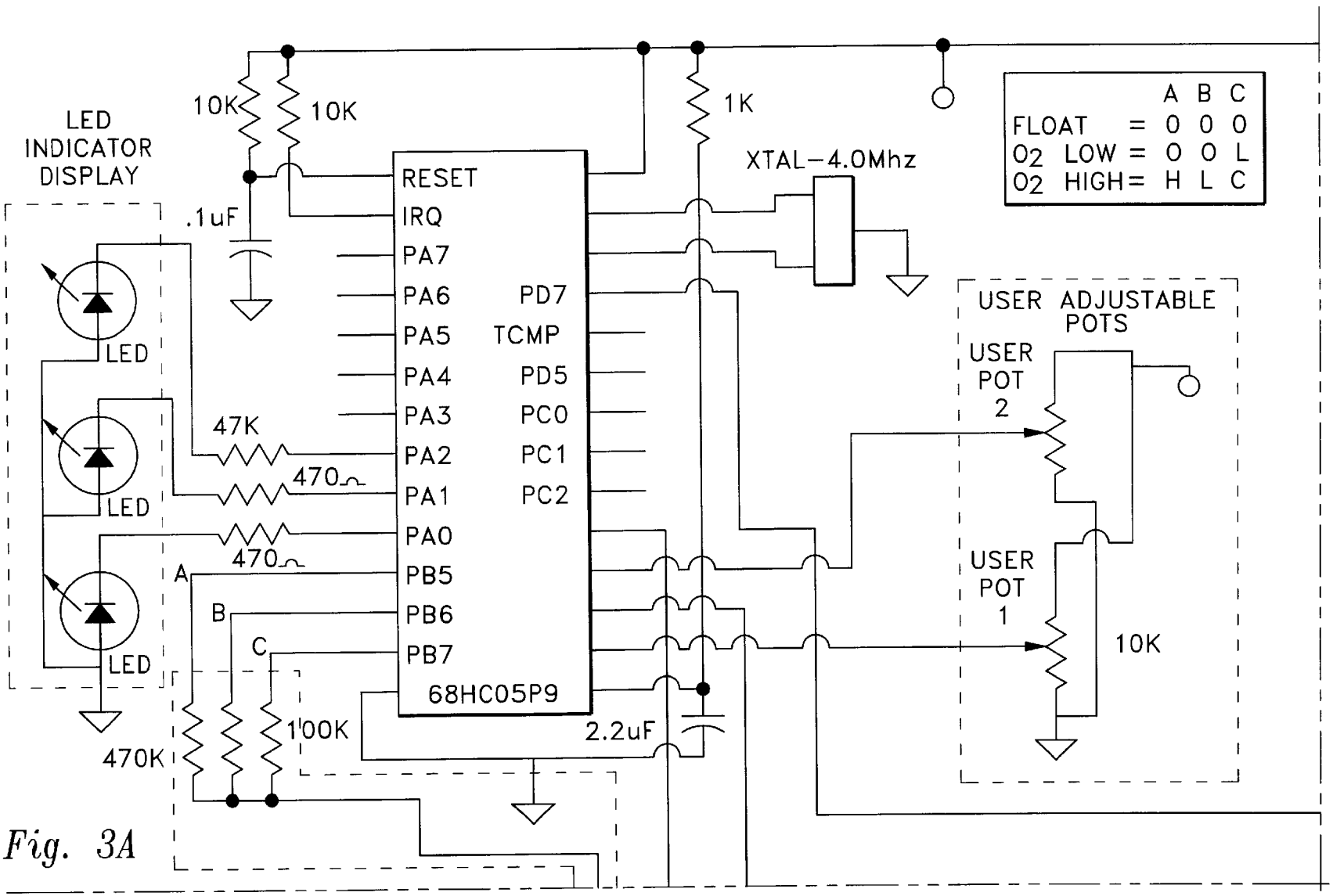
Figure 3B:
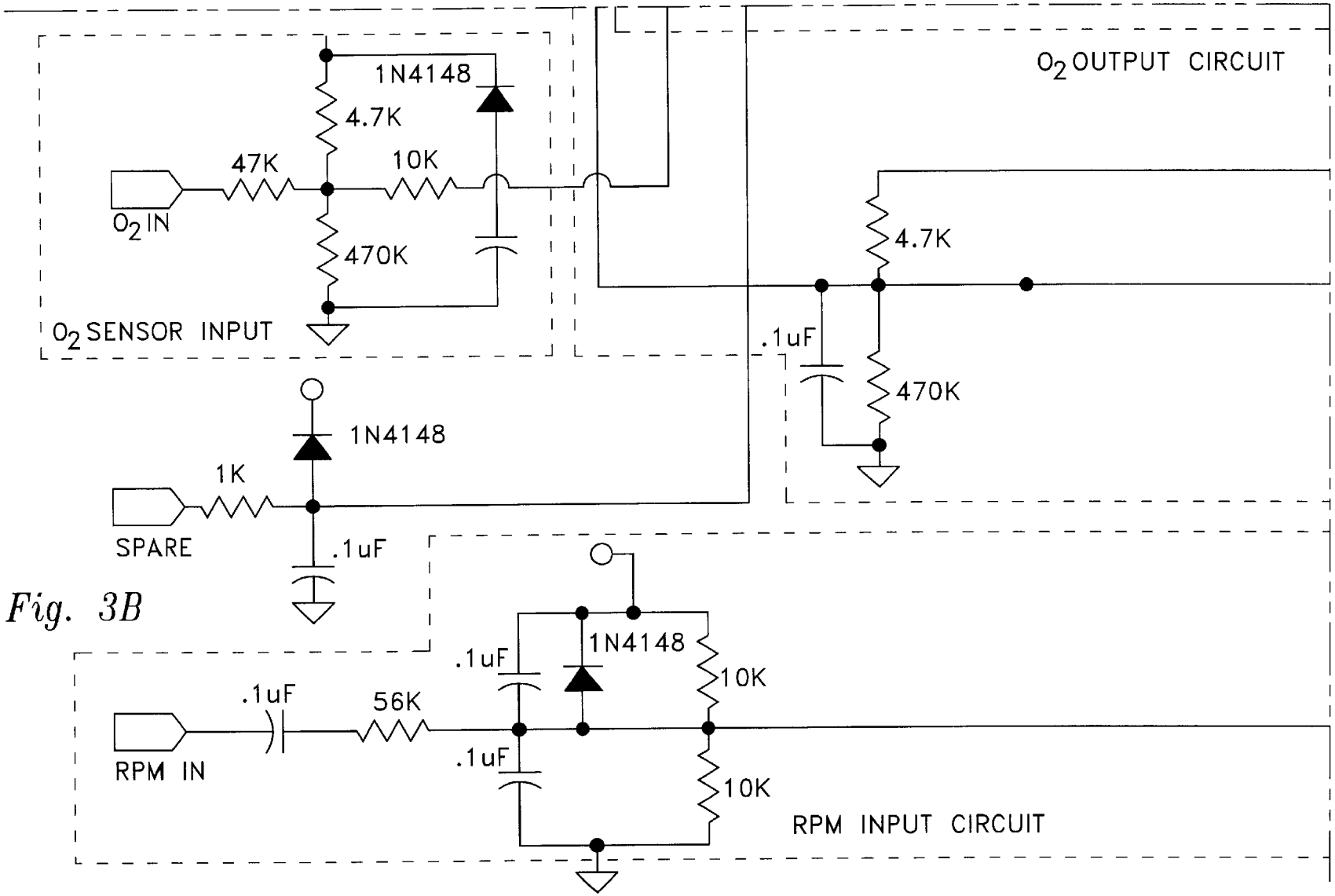
Figure 3C:
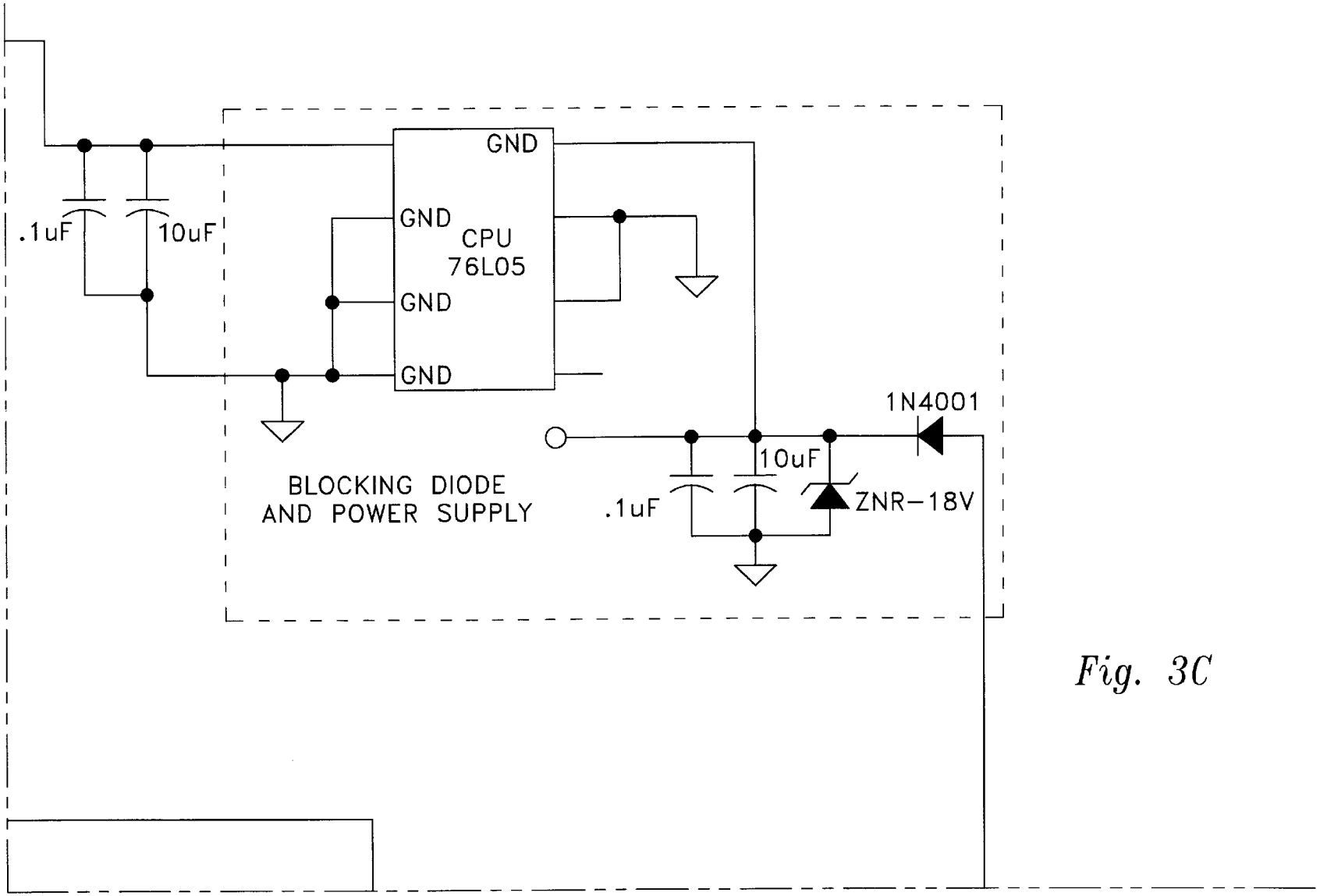
Figure 3D:
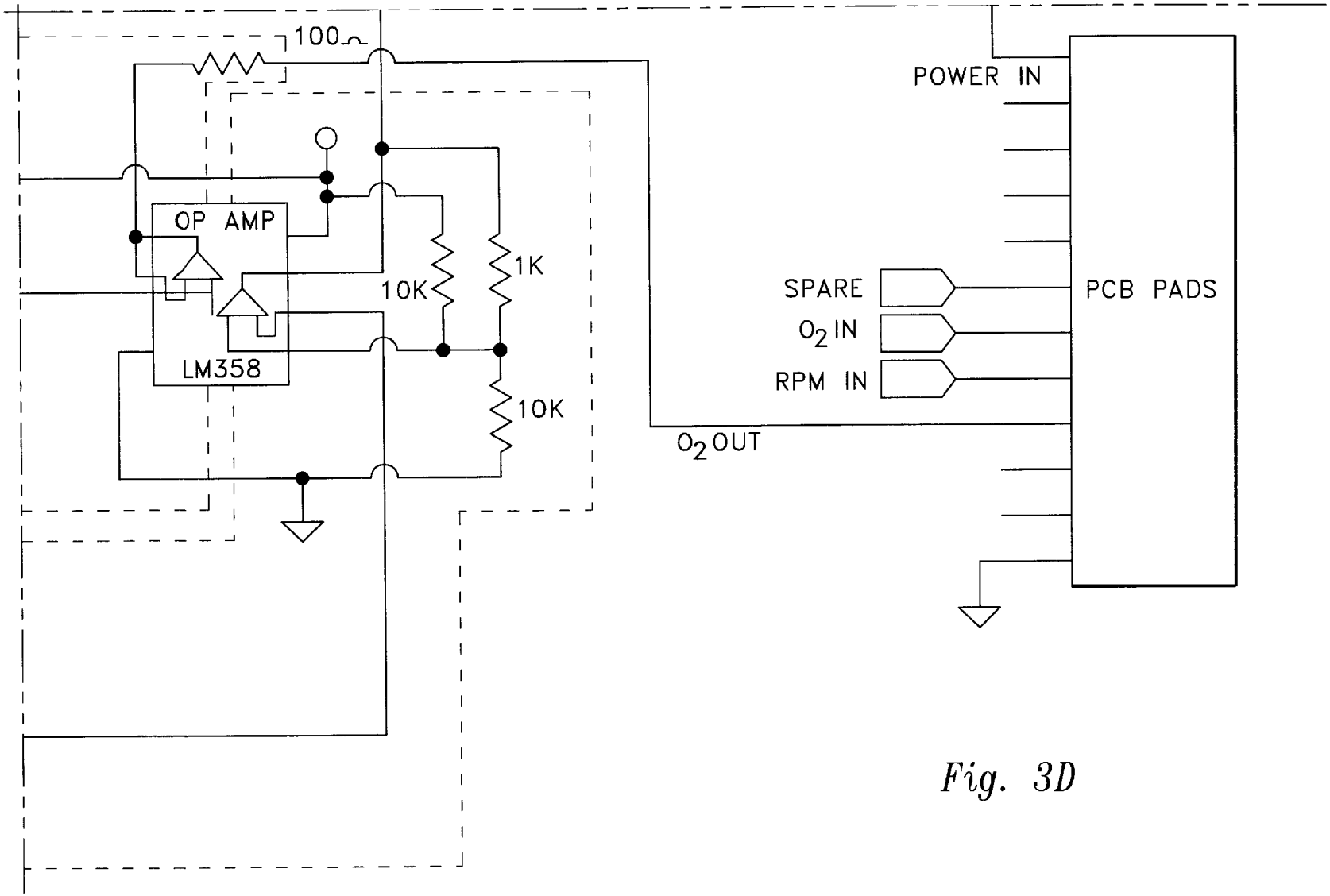

generated by an $O_2$ sensor and a modified pulse wave form (shown in dash line) such as would be produced by employing the controller of the present invention to control fuel injection;

FIG. 2 is a diagrammatic representation illustrating an internal combustion engine and exhaust system having an $O_2$ sensor, ECU and controller of the present invention operatively associated therewith; and FIG. 3, comprising FIGS. 3A, 3B, 3C and 3D, is a detailed circuit diagram of a controller constructed in accordance with the teachings of the present invention.

BEST MODE FOR CARRYING OUT THE INVENTION

FIG. 2 illustrates a conventional motor vehicle internal combustion engine 10 having fuel injectors 12. An exhaust pipe 14 extends from the engine 12, a catalytic converter 16 and a muffler 18 being operatively associated with the exhaust pipe in a conventional fashion.

An $O_2$ sensor (also known as a lambda sensor) 20 of conventional construction is employed for sensing the amount of $O_2$ in the exhaust passing through exhaust pipe 14. Also, as is conventional, an electronic control unit or module 22 (ECU) is operatively associated with fuel injectors 12, the electronic control unit being pre-programmed and receiving sensor signals from $O_2$ sensor 20.

In response to the sensor signals the electronic control unit produces fuel injector control signals controlling operation of the fuel injectors, in accordance with the preprogramming of the electronic control unit.

The fuel injectors operate in a pulsed manner. FIG. 1 is a depiction of an oscilloscope display with a typical normal $O_2$ sensor voltage wave form being shown in solid lines. The air/fuel pulses resulting from the associated electronic control unit would have the same wave form. The upper and lower portions of the normal wave form are substantially of the same magnitude and are respectively in a rich zone and a lean zone on opposed sides of a pre-determined stoichiometric line representing a set stoichiometric air/fuel mixture. That is, in a conventional arrangement the pulse portions fall generally evenly in the rich and lean zones so that the desired overall average stoichiometric value, in this instance 14.7:1, is attained or closely approximated.

The preset programming of the electronic control unit may not be such as to optimize the operation of the internal combustion engine with which the electronic control unit is associated. Attempts have been made to modify the functions of existing electronic control units by physically changing the functional parameters of the programmable eprom or computer chip, or changing the existing eprom itself inside the electronic control unit. As indicated above, various potential problems come into play when an existing electronic control unit is so modified. The physically changed or new eprom must be specific to a manufacturer's application and during use it may cause knocking, lean misfires, uncontrolled parameters during timed sequences and the signalling of alarming trouble codes in vehicles with on-board diagnostic systems.

The present invention, on the other hand, provides an approach for increasing efficiency and performance of an engine in a range still effectively controlled by the vehicle's catalyst and emission system without modifying or changing in any way the pre-programmed electronic control unit.

Referring once again to FIG. 2, a controller constructed in accordance with the teachings of the present invention is designated by reference numeral 30. Controller 30 includes sensor signal receiving means for receiving sensor signals from $O_2$ sensor 20 and sensor signal altering means for altering the sensor signals from the $O_2$ sensor prior to the sensor signals being received by the pre-programmed electronic control unit 22. The altered or modified sensor signals are transmitted from the controller to the pre-programmed electronic control unit 22. In other words, the electronic control unit does not receive a sensor signal directly from the $O_2$ sensor as is normally the case. The controller does not physically modify, change or replace the functional parameters of the existing eprom or computer chip inside the electronic control unit in any way and has a universal "closed loop" application.

The controller 30 receives and interrupts the signal from the $O_2$ sensor and alters the $O_2$ sensor signal before being received by the electronic control unit. The controller 30 calculates how long the $O_2$ input signal was lean, increases the last input lean period by a multiplication factor and then adds to that last lean period. The electronic control unit receives this modified signal from the controller and according to the electronic control unit's original equipment manufacturer's pre-programmed response values, the electronic control unit cycles richer by limiting future low end (lean period) timing signals to the injectors. The effect is an electronic control unit closed loop cycle which is richer more often than leaner during a preset timed sequence without the problems which can occur when modifying an existing electronic control unit and without signaling alarming on-board diagnostic trouble codes. This results in increased efficiency and performance of the engine in a range still effectively controlled by the vehicles catalyst and emission system.

FIG. 1 shows a dash line wave form which represents the fuel injector pulses when an electronic control unit receives $O_2$ sensor signals modified by a controller 30. It will be observed that the dash line wave cycles richer than normal. The portions of the wave in the rich zone are larger than the portions in the lean zone.

FIGS. 3A–3D illustrate circuitry and components of a preferred form of controller 30, the overall layout of the circuit being shown in FIG. 3.

The controller 30 consists of a micro computer, a power supply, input signal conditioning circuits, out circuits, function indicator displays and calibration adjustment input devices. The disclosed arrangement makes use of a Motorola 68HCO5P6 micro computer running at 4 MHz.

Power is supplied through a blocking diode that prevents damage to the circuit if voltage is applied backwards. A 5-volt linear regulator that provides a regulated output to the micro computer and other circuit components regulate voltage.

The controller 30 receives signals not only from the $O_2$ sensor 20 but also from a tach or RPM sensor 34 (FIG. 2). The $O_2$ sensor signal is passed through a filtering network which removes unwanted noise and then through a protection network which protects sensitive components from high voltage transients that may be present on the $O_2$ signal line. The signal is then routed into the analog to digital converter in the micro computer where further signal processing is performed.

The RPM signal is received from a wire attached to the negative side of the coil and/or to other inductive sources. The signal is then routed through a filter and level shifting network that transform the signal into a clean square wave that can be routed to the micro computer timer input where further processing takes place.

The micro computer's outputs are routed through a circuit that filters and shifts the voltage levels so that the final $O_2$ output conforms to the expected $O_2$ sensor signal levels.

The circuit includes a set of three LED indicator displays that inform the operator of the circuit's functions and modes of operation. They further serve as a diagnostics aid.

The circuit also includes two user adjustments that are used to set the RPM triggering level and amount of enrichment, the latter being a limited parameter adjustment which determines how much the low end timing to the injectors can be influenced. These calibration adjustments are mounted on the circuit board. A switch 36 (FIG. 2) is associated with the controller so that the operator can turn the controller on or off manually. If turned off, the $O_2$ sensor signal can pass straight through to the electronic control unit.

Another advantage, as mentioned above, is that the engine's Nox sensor perceives the richer mixture produced by the invention, allowing the ECU to advance the acceleration timing (in accordance with the ECU preprogrammed response values) for better throttle acceleration response.

What is claimed is:

1. Apparatus for improving the performance of the internal combustion engine of a motor vehicle having fuel injectors, an $O_2$ sensor for sensing the amount of $O_2$ in exhaust produced by said internal combustion engine and a preprogrammed electronic control unit for receiving sensor signals from said $O_2$ sensor and in response thereto producing fuel injector control signals controlling operation of said fuel injectors, said apparatus comprising a controller interposed between said $O_2$ sensor and said preprogrammed electronic control unit, said controller including sensor signal receiving means for receiving sensor signals from said $O_2$ sensor and sensor signal altering means for altering the sensor signals from said $O_2$ sensor prior to said sensor signals being received by said preprogrammed electronic control unit to modify the fuel injector control signals produced by said preprogrammed electronic control unit without modifying the programming thereof.

2. The apparatus according to claim 1 wherein said sensor signal altering means of said controller is cooperable with said $O_2$ sensor and said preprogrammed electronic control unit to cause said fuel injectors to provide a richer fuel mixture to said internal combustion engine over a period of time than would be provided in the absence of said controller.

3. The apparatus according to claim 2 wherein said sensor signal altering means of said controller and said preprogrammed electronic control unit are cooperable to produce richer fuel injector pulse portions larger than the lean pulse portions produced thereby.

4. The apparatus according to claim 1 additionally including a tach sensor for sensing the engine speed of said internal combustion engine, said controller cooperable with said tach sensor to alter the sensor signals only after a minimum engine speed has been sensed by said tach sensor and triggers operation of said sensor signal altering means.

5. The apparatus according to claim 4 wherein said controller includes adjustment means for adjusting the magnitude of the minimum engine speed triggering operation of said sensor signal altering means.

6. The apparatus according to claim 4 wherein said controller additionally comprises means for establishing the degree to which low end timing to the fuel injectors are influenced by said controller.

7. The apparatus according to claim 1 including switch means for selectively deactivating said sensor signal altering means.

8. A method for improving the performance of the internal combustion engine of a motor vehicle having fuel injectors, an $O_2$ sensor for sensing the amount of $O_2$ in exhaust produced by said internal combustion engine and a preprogrammed electronic control unit for receiving sensor signals from said $O_2$ sensor and in response thereto producing fuel injector control signals controlling operation of said fuel injectors, said method comprising the steps of:

interposing a controller between said $O_2$ sensor and said preprogrammed electronic control unit;

directing sensor signals from said $O_2$ sensor to the controller and not directly to said preprogrammed electronic control unit;

at said controller, modifying the sensor signals from said $O_2$ sensor to produce modified sensor signals;

transmitting said modified sensor signals from said controller to said preprogrammed electronic control unit;

without changing the programming of said preprogrammed electronic control unit, and solely as a function of said modified sensor signals being transmitted from said controller to said preprogrammed electronic control unit, generating modified fuel injector control signals; and employing said modified fuel injector control signals to cause fuel injectors to provide a richer fuel mixture to said internal combustion engine over a period of time than would be provided in the absence of the step of modifying the sensor signals from said $O_2$ sensor.

9. The method according to claim 8 wherein said modified fuel injector control signals are cooperable to produce rich fuel injector pulse portions larger than the lean pulse portions produced thereby.

10. The method according to claim 8 including the additional steps of sensing the engine speed of said internal combustion engine and modifying the sensor signals only after a minimum engine speed has been sensed.

11. The method according to claim 10 including the step of adjusting the magnitude of the minimum engine speed required to initiate modification of said sensor signals.

12. The method according to claim 8 including the step of establishing the degree to which low end timing to the fuel injectors is influenced by modification of said sensor signals by said controller.

13. The method according to claim 8 wherein said sensor signals are modified at said controller to provide modified sensor signals signaling the preprogrammed electronic control unit that an air/fuel mixture introduced into said internal combustion engine by said fuel injectors is leaner than it is in actuality.

14. The method according to claim 8 wherein said step of modifying said sensor signals comprises modifying the portions of the sensor signals relating to lean periods by multiplying the normal lean periods by a predetermined multiplication factor and reflecting the resultant period in the modified sensor signal.

15. The method according to claim 8 including the additional steps of sensing the richer fuel mixture with an Nox sensor and advancing the acceleration timing of the internal combustion engine by the preprogrammed electronic control unit as a result of sensing of the richer fuel mixture by the Nox sensor.

* * * * *